US006612677B2

(12) United States Patent
Su et al.

(10) Patent No.: US 6,612,677 B2
(45) Date of Patent: Sep. 2, 2003

(54) INK DROP SENSOR

(75) Inventors: Wen-Li Su, Vancouver, WA (US); Patrick J. Therien, Battle Ground, WA (US); Steve O'Hara, Camas, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 145 days.

(21) Appl. No.: 09/915,980

(22) Filed: Jul. 25, 2001

(65) Prior Publication Data

US 2003/0020774 A1 Jan. 30, 2003

(51) Int. Cl.[7] ..... B41J 2/01
(52) U.S. Cl. ..... 347/19
(58) Field of Search ..... 347/19, 81

(56) References Cited

U.S. PATENT DOCUMENTS 6,039,429 A * 3/2000 Balousek ..... 347/19
6,062,668 A * 5/2000 Cruz-Uribe ..... 347/19
6,086,190 A 7/2000 Schantz et al. ..... 347/81
6,315,383 B1 * 11/2001 Sarmast et al. ..... 347/19

OTHER PUBLICATIONS

Hewlett–Packard Company patent application Ser. No. 09/773,881, filed Jan. 31, 2001, entitled: "Uni–Directional Waste Ink Removal System".

Hewlett–Packard Company patent application Ser. No. 09/773,873, filed Jan. 31, 2001, entitled: "Ink Drop Detector Waste Ink Removal System".

* cited by examiner

*Primary Examiner*—Craig Hallacher

(57) ABSTRACT

A sensor includes an ink drop sensing element integral to a printed circuit board. Sensing circuitry is coupled to the printed circuit board and may be configured to receive electrical signals from the sensing element. A method of manufacturing such an ink drop sensor and a printing mechanism having such an ink drop sensor are also provided.

13 Claims, 5 Drawing Sheets

INK DROP SENSOR

The present invention relates generally to printing mechanisms, such as inkjet printers or inkjet plotters. Printing mechanisms often include an inkjet printhead which is capable of forming an image on many different types of media. The inkjet printhead ejects droplets of colored ink through a plurality of orifices and onto a given media as the media is advanced through a printzone. The printzone is defined by the plane created by the printhead orifices and any scanning or reciprocating movement the printhead may have back-and-forth and perpendicular to the movement of the media. Conventional methods for expelling ink from the printhead orifices, or nozzles, include piezo-electric and thermal techniques which are well-known to those skilled in the art. For instance, two earlier thermal ink ejection mechanisms are shown in U.S. Pat. Nos. 5,278,584 and 4,683,481, both assigned to the present assignee, the Hewlett-Packard Company.

In order to achieve a high level of image quality in an inkjet printing mechanism, it is often desirable that the printheads have: consistent and small ink drop size, consistent ink drop trajectory from the printhead nozzle to the print media, and extremely reliable inkjet nozzles which do not clog. To this end, many inkjet printing mechanisms contain a service station for the maintenance of the inkjet printheads. These service stations may include scrapers, ink-solvent applicators, primers, and caps to help keep the nozzles from drying out during periods of inactivity. Additionally, inkjet printing mechanisms often contain service routines which are designed to fire ink out of each of the nozzles and into a waste spittoon in order to prevent nozzle clogging.

Despite these preventative measures, however, there are many factors at work within the typical inkjet printing mechanism which may clog the inkjet nozzles, and inkjet nozzle failures may occur. For example, paper dust may collect on the nozzles and eventually clog them. Ink residue from ink aerosol or partially clogged nozzles may be spread by service station printhead scrapers into open nozzles, causing them to be clogged. Accumulated precipitates from the ink inside of the printhead may also occlude the ink channels and the nozzles. Additionally, the heater elements in a thermal inkjet printhead may fail to energize, despite the lack of an associated clogged nozzle, thereby causing the nozzle to fail.

Clogged or failed printhead nozzles result in objectionable and easily noticeable print quality defects such as banding (visible bands of different hues or colors in what would otherwise be a uniformly colored area) or voids in the image. In fact, inkjet printing systems are so sensitive to clogged nozzles, that a single clogged nozzle out of hundreds of nozzles is often noticeable and objectionable in the printed output.

It is possible, however, for an inkjet printing system to compensate for a missing nozzle by removing it from the printing mask and replacing it with an unused nozzle or a used nozzle on a later, overlapping pass, provided the inkjet system has a way to tell when a particular nozzle is not functioning. In order to detect whether an inkjet printhead nozzle is firing, a printing mechanism may be equipped with a low cost ink drop detection system, such as the one described in U.S. Pat. No. 6,086,190 assigned to the present assignee, Hewlett-Packard Company. This drop detection system utilizes an electrostatic sensing element which is imparted with an electrical stimulus when struck by a series of ink drop bursts ejected from an inkjet printhead.

In practical implementation, however, this electrostatic sensing element has some limitations. The sensing element may adversely react with ink residue formed as a result of contact with the ink drop bursts. Additionally, drop detect signals provided from the sensing element to the sensing electronics may easily subjected to noise due to their small amplitudes. Furthermore, the ink residue remains conductive and can short-circuit the sensing electronics.

Therefore, it would be desirable to have an electrostatic sensing element and related electronics which have a substantial immunity to the potentially harmful effects of conductive ink residue and which may easily be integrated into various printing mechanism designs. It would also be desirable to have a method of efficiently and economically constructing such an electrostatic sensing element and electronics.

DETAILED DESCRIPTION OF THE PREFERRED EMBODIMENTS

Figure 1:
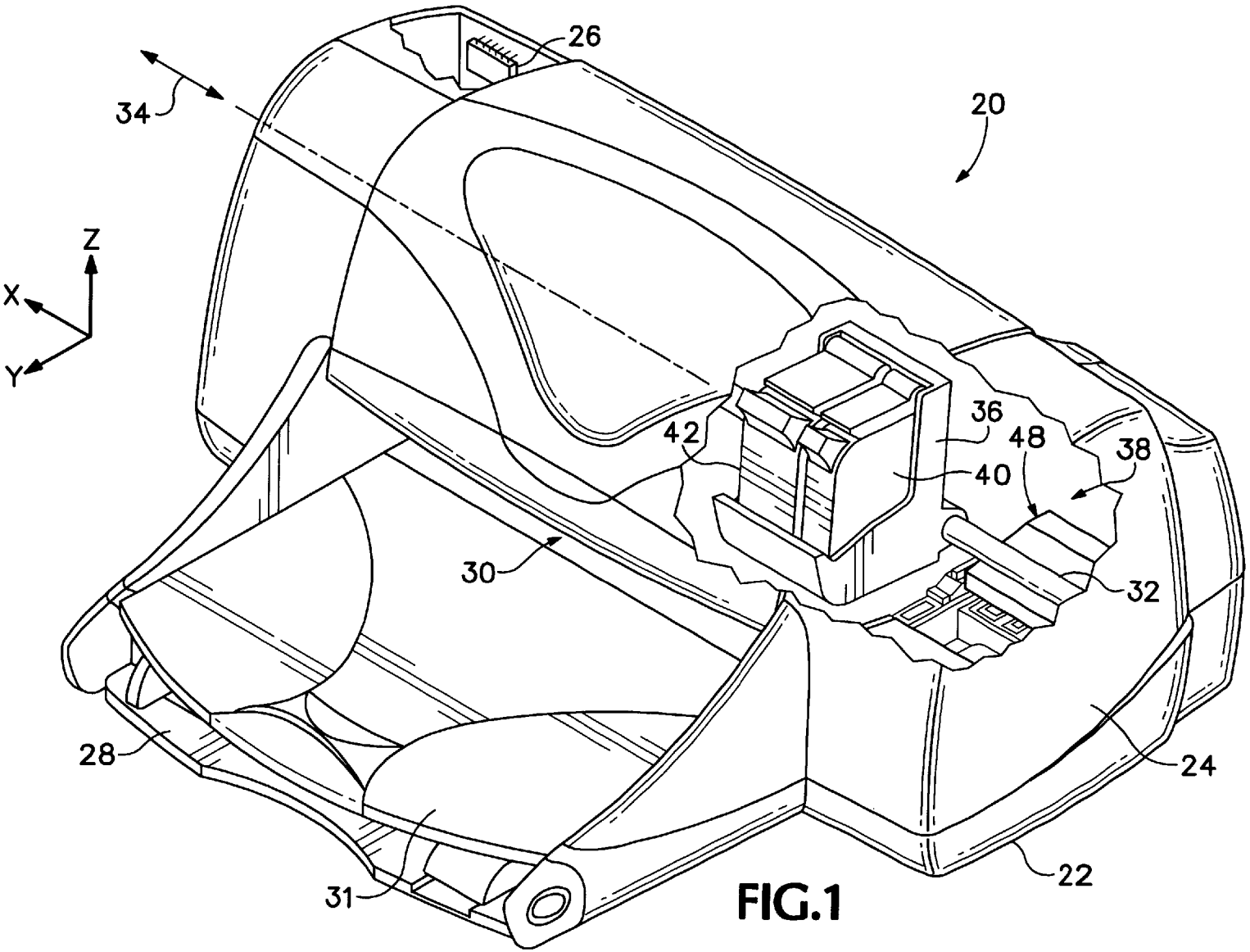
FIG. 1 is a fragmented perspective view of one form of an inkjet printing mechanism, here illustrating an embodiment of an ink drop sensor.

FIG. 1 illustrates an embodiment of a printing mechanism, here shown as an inkjet printer 20, constructed in accordance with the present invention, which may be used for printing on a variety of media, such as paper, transparencies, coated media, cardstock, photo quality papers, and envelopes in an industrial, office, home or other environment. A Variety of inkjet printing mechanisms are commercially available. For instance, some of the printing mechanisms that may embody the concepts described herein include desk top printers, portable printing units, wide-format printers, hybrid electrophotographic-inkjet printers, copiers, cameras, video printers, and facsimile machines, to name a few. For convenience the concepts introduced herein are described in the environment of an inkjet printer 20.

While it is apparent that the printer components may vary from model to model, the typical inkjet printer 20 includes a chassis 22 surrounded by a frame or casing enclosure 24, typically of a plastic material. The printer 20 also has a printer controller, illustrated schematically as a microprocessor 26, that receives instructions from a host device, such as a computer or personal data assistant (PDA) (not shown). A screen coupled to the host device may also be used to display visual information to an operator, such as the printer status or a particular program being run on the host device. Printer host devices, such as computers and PDA's, their input devices, such as a keyboards, mouse devices, stylus devices, and output devices such as liquid crystal display screens and monitors are all well known to those skilled in the art.

A conventional print media handling system (not shown) may be used to advance a sheet of print media (not shown) from the media input tray 28 through a printzone 30 and to an output tray 31. A carriage guide rod 32 is mounted to the chassis 22 to define a scanning axis 34, with the guide rod 32 slideably supporting an inkjet carriage 36 for travel back and forth, reciprocally, across the printzone 30. A conventional carriage drive motor (not shown) may be used to propel the carliage 36 in response to a control signal received from the controller 26. To provide carriage positional feedback information to controller 26, a conventional encoder strip (not shown) may be extended along the length of the printzone 30 and over a servicing region 38. A conventional optical encoder reader may be mounted on the back surface of printhead carriage 36 to read positional information provided by the encoder strip, for example, as described in U.S. Pat. No. 5,276,970, also assigned to the Hewlett-Packard Company, the present assignee. The manner of providing positional feedback information via the encoder strip reader, may also be accomplished in a variety of ways known to those skilled in the art.

In the printzone 30, the print media receives ink from an inkjet cartridge, such as a black ink cartridge 40 and a color inkjet cartridge 42. The cartridges 40 and 42 are also often called "pens" by those in art. The black ink pen 40 is illustrated herein as containing a pigment-based ink. For the purposes of illustration, color pen 42 is described as containing three separate dye-based inks which are colored cyan, magenta, and yellow, although it is apparent that the color pen 42 may also contain pigment-based inks in some implementations. It is apparent that other types of inks may also be used in the pens 40 and 42, such as paraffin-based inks, as well as hybrid or composite inks having both dye and pigment characteristics. The illustrated printer 20 uses replaceable printhead cartridges where each pen has a reservoir that carries the entire ink supply as the printhead reciprocates over the printzone 30. As used herein, the term "pen" or "cartridge" may also refer to an "off-axis" ink delivery system, having main reservoirs (not shown) for each ink (black, cyan, magenta, yellow, or other colors depending on the number of inks in the system) located in an ink supply region. In an off-axis system, the pens may be replenished by ink conveyed through a conventional flexible tubing system from the stationary main reservoirs which are located "off-axis" from the path of printhead travel, so only a small ink supply is propelled by carriage 36 across the printzone 30. Other ink delivery or fluid delivery systems may also employ the systems described herein, such as "snapper" cartridges which have ink reservoirs that snap onto permanent or semi-permanent print heads.

The illustrated black pen 40 has a printhead 44, and color pen 42 has a tri-color printhead 46 which ejects cyan, magenta, and yellow inks. The printheads 44, 46 selectively eject ink to form an image on a sheet of media when in the printzone 30. The printheads 44, 46 each have an orifice plate with a plurality of nozzles formed therethrough in a manner well known to those skilled in the art. The nozzles of each printhead 44, 46 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 34, with the length of each array determining the maximum image swath for a single pass of the printhead. The printheads 44, 46 are thermal inkjet printheads, although other types of printheads may be used, such as piezoelectric printheads. The thermal printheads 44, 46 typically include a plurality of resistors which are associated with the nozzles. Upon energizing a selected resistor, a bubble of gas is formed which ejects a droplet of ink from the nozzle and onto the print media when in the printzone 30 under the nozzle. The printhead resistors are selectively energized in response to firing command control signals delivered from the controller 26 to the printhead carriage 36. During or after printing, the inkjet carriage 36 may be moved along the carriage guide rod 32 to the servicing region 38 where a service station 48 may perform various servicing functions known to those in the art, such as, priming, scraping, and capping for storage during periods of non-use to prevent ink from drying and clogging the inkjet printhead nozzles.

Figure 2:
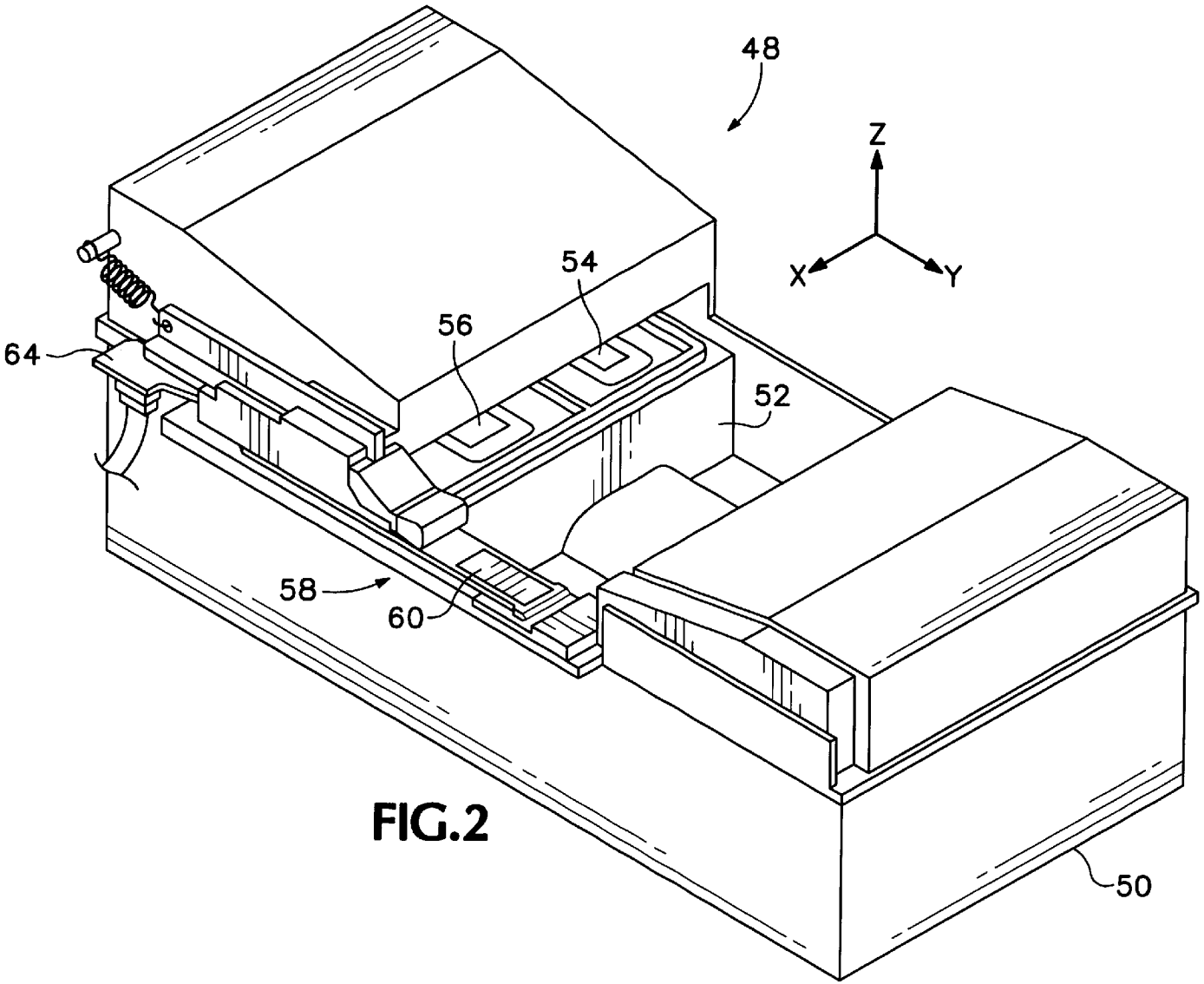
FIG. 2 is an enlarged, perspective view of the ink drop sensor attached to an ink printhead service station as illustrated in FIG. 1

FIG. 2 shows the service station 48 in detail. A service station frame 50 is mounted to the chassis 22, and houses a moveable pallet 52. The moveable pallet 52 may be driven by a motor (not shown) to move in the frame 50 in the positive and negative Y-axis directions. The moveable pallet 52 may be driven by a rack and pinion gear powered by the service station motor in response to the microprocessor 26 according to methods known by those skilled in the art. An example of such a rack and pinion system in an inkjet cleaning service station can be found in U.S. Pat. No. 5,980,018, assigned to the Hewlett-Packard Company, also the current assignee. The end result is that pallet 52 may be moved in the positive Y-axis direction to a servicing position and in the negative Y-axis direction to an uncapped position. The pallet 52 supports a black printhead cap 54 and a tricolor printhead cap 56 to seal the printheads 44 and 46, respectively, when the moveable pallet 52 is in the servicing position.

FIG. 2 also shows an embodiment of an ink drop sensor 58 supported by the service station frame 50. Clearly, the ink drop sensor 58 could be mounted in other locations along the printhead scanning axis 34, including the right side of the service station frame 50, inside the service station 48, or the opposite end of the printer from the service station 48, for example.

Figures 3, 4, 5:
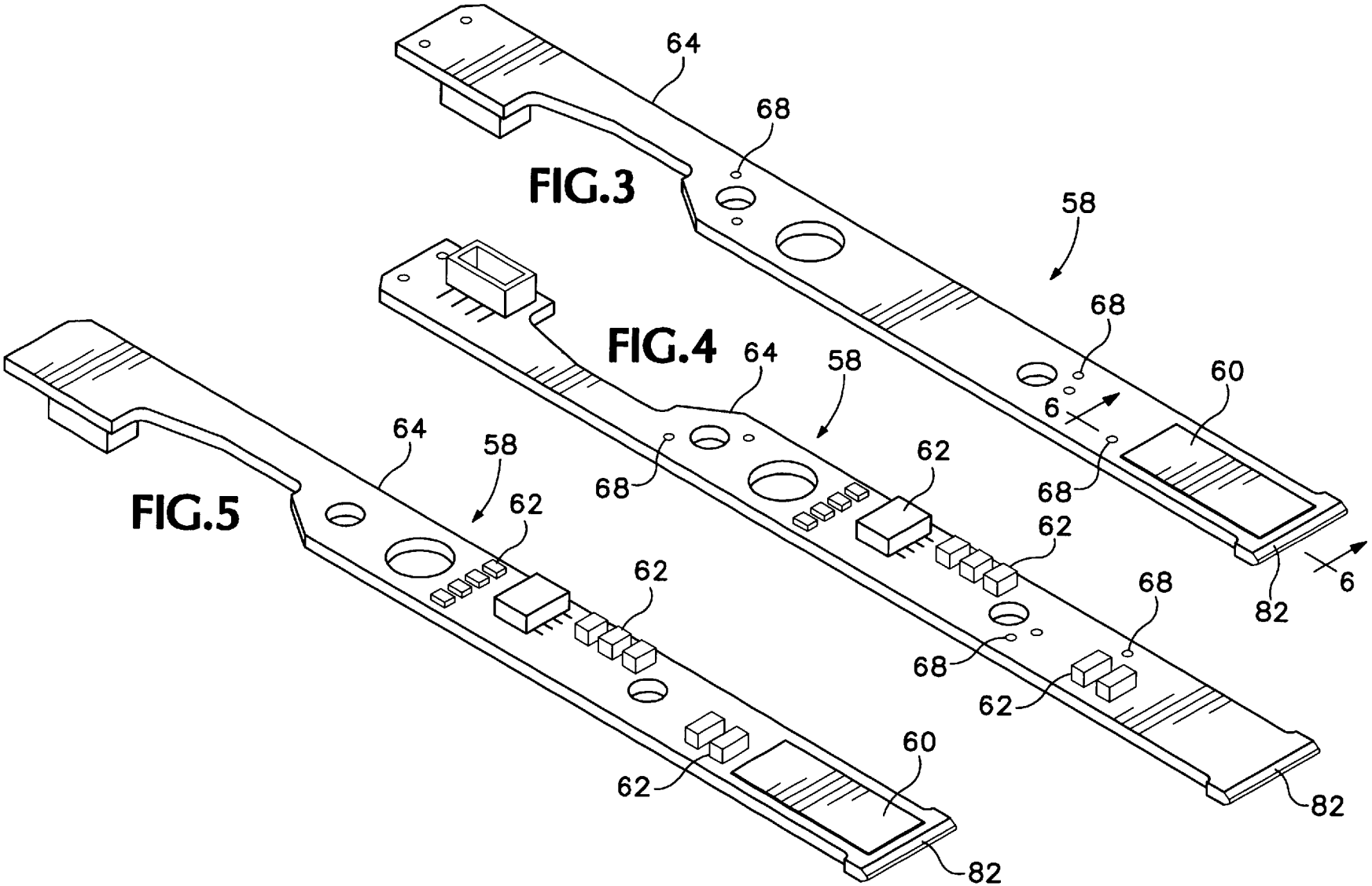
FIGS. 3 and 4 are enlarged, perspective views, FIG. 3 from the top and FIG. 4 from the bottom, of one embodiment of a dual-sided ink drop sensor.
FIG. 5 is an enlarged perspective view of one embodiment of a single sided ink drop sensor.

The ink drop sensor may be seen more clearly in FIGS. 3 and 4. Within the sensor 58 are integrated a sensing element, or "target" 60 and electrical components 62 for filtering and amplification of the signals from the target 60. The sensor 58 may be assembled on a single printed circuit board (PCB) 64. FIG. 3 shows the sensor 58 from the "target side" since, in this view, target 60 is facing upward. FIG. 4 shows the sensor 58 flipped over from the target side, revealing the "component side" since, in this view, the electrical components 62 are visible. In normal operation, the "target side" of the sensor 58 is usually facing up; and ink droplets may be fired onto the target 60 and detected according to the apparatus and method described in U.S. Pat. No. 6,086,190, assigned to the Hewlett-Packard Company, the present assignee. The target is preferably constructed of a conductive material which will not interact with the inks it will be detecting, such as, for example, gold, palladium, stainless steel, or a conductive polymer. The conductive target material may be plated onto the PCB 64. Other methods of placing, attaching, coating, or depositing conductive material onto a printed circuit board are well-known in the art and they may be used as well.

By integrating the target 60 and the filtering and amplification components 62 onto a single PCB 64, several advantages are made. No wires or interconnects are needed to take the signal from the target 60 to the amplification and filtering electronics 62, thereby reducing assembly time. The absence of wires or interconnects between the target 60 and the electrical components 62 also reduces the amount of electrical noise when measurements are made. Noise tolerances are now kept at standard PCB noise tolerance levels which are acceptable for the purposes of the drop detection measurement. By using a feature on the PCB 64 for the sensing element, or target 60, it is simple to change the shape of the target 60 to match design needs for a given system. For example, one current design for a target 60 corresponds to a half-inch printhead. However, printed circuit board technology easily allows the size and shape of the target to be stretched or altered to quickly accommodate other printhead sizes, for example, a one-inch printhead. Printing mechanisms are often very compact, and the low-profile of a PCB-based sensor 58, as well as the ease of designing PCB shapes to weave around other parts, helps designers fit the sensor into tight areas of printing mechanisms without having to increase the size of the printing mechanism just to have an ink drop sensor 58.

The benefits from having the target 60 and the amplification and filtering electronics 62 integrated closely together raises the concern of ink contamination of the filtering electronics 62. Ink residue and ink aerosol are highly conductive and are easily capable of shorting out the electrical components 62. An alternate embodiment of an ink drop sensor 58 is shown in FIG. 5. The sensor 58 of FIG. 5 has a sensing element, or target 60, and filtering and amplification components 62 integrated onto a single PCB 64, however, in this case, the components 62 are mounted on the same side of the PCB 64 as the target 60. Although cleaning mechanisms may be employed to clean the target 60, the ink droplets which are fired onto the target 60 tend to migrate and may easily come into contact with the electrical components 62. Additionally, ink aerosol may be present within a printing mechanism. The ink aerosol tends to settle on upward facing horizontal surfaces, thereby posing a shorting threat not only to the electronics 62 on the ink drop sensor 58 as illustrated in FIG. 5, but also to other circuitry within the printing mechanism 20. Therefore, as a first order degree of protection against shorting from ink residue on the target 60 and ink aerosol in the printing mechanism, it is preferable to have an ink drop sensor 58 which integrates the target 60 and the filtering and amplification electronics 62 on opposite sides of a PCB 64 as illustrated in FIGS. 3 and 4. As a second degree of protection it is desirable to apply a protective coating of a material such as silicone, palyene, or epoxy to the components to further protect them from migrating ink residue and ink aerosol shorts.

Figure 6:
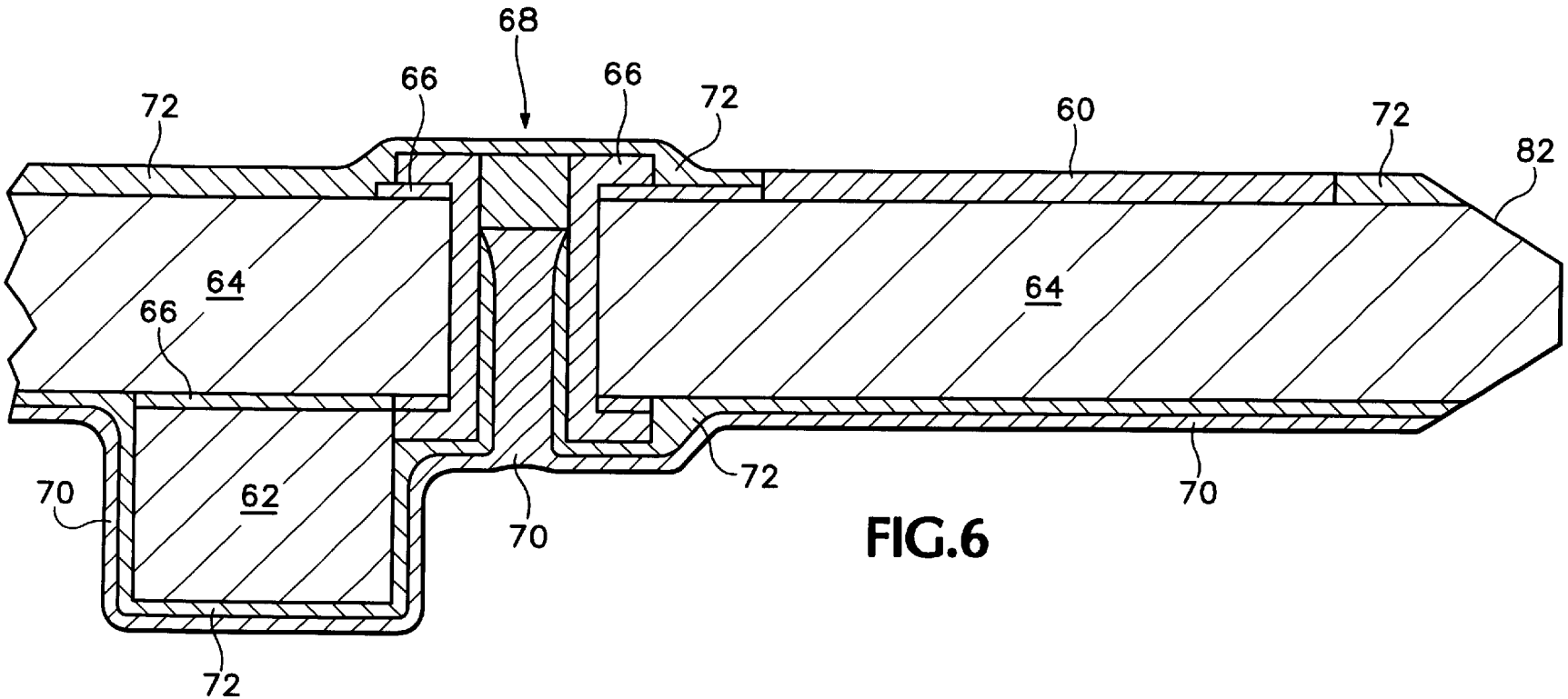
FIG. 6 is an enlarged, fragmented, cross-sectional side elevational view of the ink drop sensor illustrated in FIGS. 3 and 4.

FIG. 6 illustrates a portion of the ink drop sensor from FIG. 3 in a cross-sectional elevational view. The target 60 can be seen on the top of the PCB 64, and some of the filtering and amplification electronics 62 can be seen on the bottom side of the PCB 64. Printed circuit traces 66 connect the various electric elements, and through-hole vias 68 connect the circuit traces 66 on the target 60 side of the PCB 64 to the circuit traces 66 on the electrical component side of the PCB 64. The electrical component side of the PCB 64, including the through-hole vias 68 are coated with a protective coating 70 in order to seal the electronics from possible shorts due to ink residue. The protective coating may also be applied to the target side of the PCB 64, however, the coating would have to be applied in such away that the target. 60 was not covered. The solder mask should cover all exposed electrical paths, except for the top side of target 60. Since there are no components or exposed traces other than the target 60 on the target side, the solder mask 72 may remain exposed on the target side of the PCB 64, without having to perform a protective coating on the target side. It is desirable, however, to select a material for solder mask 72 which will not react with the ink residue or aerosol. A suitable material for the solder mask 72 is a liquid photo imageable material manufactured by Taiyo, product number PSR-4000 (Z-100). The single-sided ink drop sensor 58 embodiment illustrated in FIG. 5 may also be protective coated, however care should be taken to not coat over the target. Other circuit boards within the printing mechanism may also be protectively coated to avoid the harmful affects of shorting from ink residue and ink aerosol.

Figure 7:
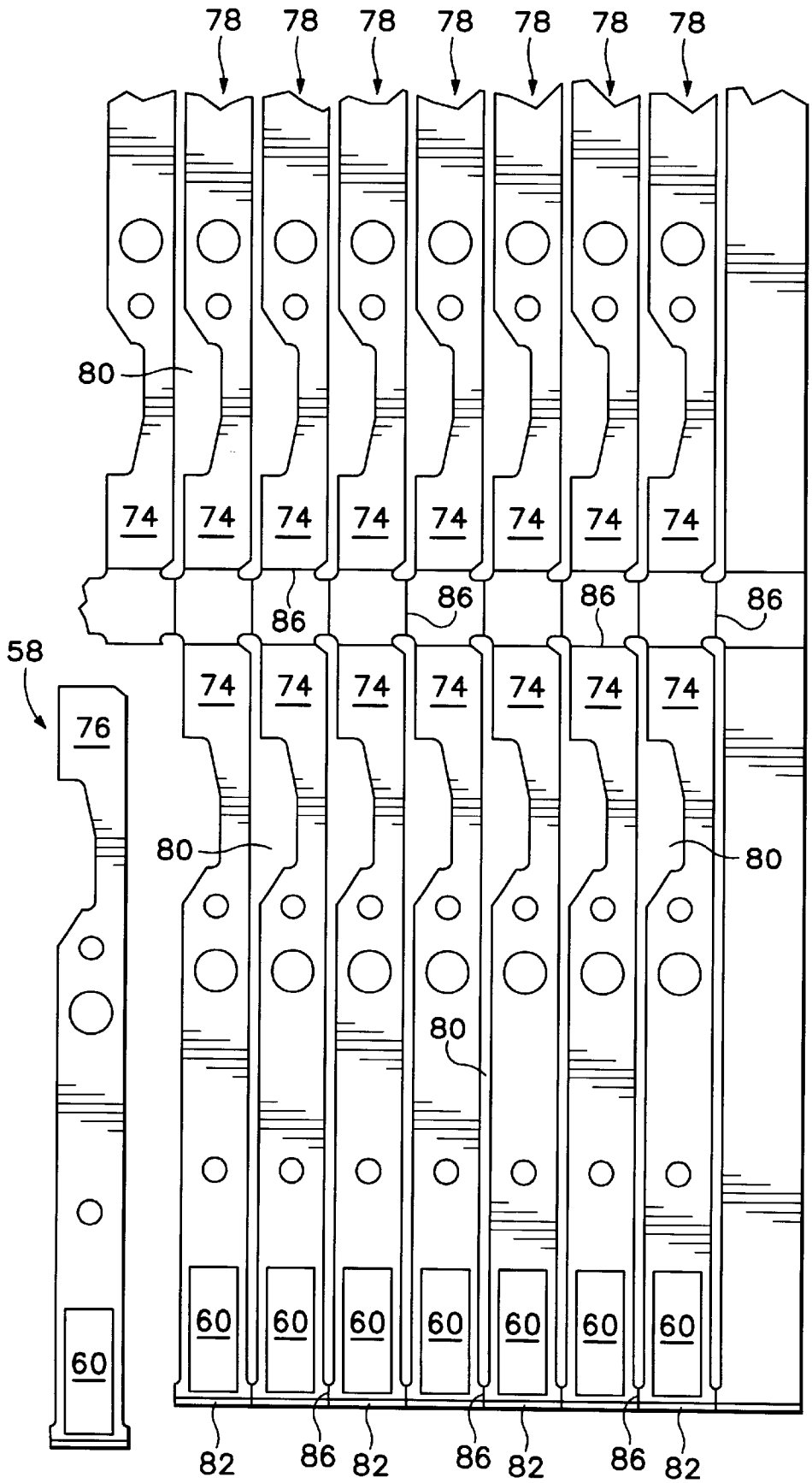
FIG. 7 is a schematic, fragmented top view of multiple ink drop sensors illustrated in an embodiment of a fabrication stage.

As pointed out earlier, the integrated ink drop sensor 58 has a reduced need for connecting wires and interconnects. By limiting the number of connections to the ink drop sensor, the PCB is able to be made thinner, and the long edges of the PCB are able to be cut with a router, thereby decreasing the width tolerance and allowing the ink drop sensor to fit into tighter spaces. FIG. 7 illustrates a schematic, fragmented top view of multiple ink drop sensor assemblies 74 illustrated in an embodiment of a fabrication stage. A broken-out sensor assembly 76 illustrates schematically what each final ink sensor 58 may look like. The sensor assemblies 74 are laid out and printed on a circuit board such that pairs 78 of sensor assemblies 74 lie short end to short end with their targets 60 facing outwardly. Printed circuits are etched and created, targets 60 are formed or plated, holes may be drilled or routed into the PCB, electrical components 62 are mounted, and a protective coating 70 is coated onto the PCB.

The voids 80 defined between sensor assemblies 74 are routed out along the long edges of each sensor assembly 74. The edges of the PCB assembly along the targets 60, may be routed to provide a chamfered edge 82 at the end of broken-out sensor assembly 76 in order to provide a smooth transition for any cleaning mechanism which wipes or scrapes across the target 60 and the chamfered edge 82. Score lines 86 are cut into the PCB assembly along the remaining outlines of each sensor assembly 74 which were not previously cut by router. Having routed most of the areas between each sensor assembly 74 and minimizing the number of score lines 86, each sensor assembly 74 may then easily be broken out of the PCB assembly, like broken-out sensor assembly 76 to create an ink drop sensor 58. Also, by minimizing the number and size of score lines 86 between each sensor assembly 74, the number of remnants which may break off of each sensor assembly 76 after it is broken out of the PCB assembly is reduced. These remnants tend to be long glass fibers which can come loose inside of the printing mechanism, pick up ink reside, and then settle on electronics, possibly causing ink shorts, or interfering with the printheads.

Integrating a sensing element and amplification and filtering electronics into a single PCB assembly, while taking steps to minimize the harmful effects of ink residue and ink aerosol enables low noise ink drop measurements in a design which may be adapted for different printing mechanisms while providing an efficient manner of ink drop sensor manufacturing. In discussing various components of the ink drop sensor 58, various benefits have been noted above.

It is apparent that a variety of other structurally equivalent modifications and substitutions may be made to construct an ink drop sensor according to the concepts covered herein depending upon the particular implementation, while still falling within the scope of the claims below.

We claim:

1. A sensor, comprising:

a printed circuit board (PCB) having:

a first side; and a second side opposite the first side;

an ink drop sensing element integral to the PCB first side;

sensing circuitry, coupled to the PCB second side, configured to receive electrical signals from the sensing element; and wherein the PCB further comprises:

conductive traces on the first side and the second side of the PCB;

conductive through-hole-vias which connect select traces on the first side to select traces on the second side; and a mask covering the conductive traces the first side and the second side of the PCB in areas where no electrical connection is desired.

2. A sensor according to claim 1, further comprising a protective coating to protect the sensing circuitry, through-hole-vias, and conductive traces which are not covered by the mask from conductive ink residue.

3. A sensor according to claim 2, wherein the mask covering the conductive traces comprises a material which does not react with the ink residue.

4. A sensor according to claim 3, wherein the PCB further comprises a chamfered edge.

5. A sensor according to claim 4, wherein, the sensing element comprises gold.

6. A sensor according to claim 4, wherein the sensing element comprises palladium.

7. A sensor according to claim 4, wherein the sensing element comprises stainless steel.

8. A sensor according to claim 4, wherein the sensing element comprises a conductive polymer.

9. A sensor according to claim 4, wherein the sensing element comprises a non-corrosive, inert, and conductive covering.

10. A printing mechanism, comprising:

a printhead which selectively ejects ink; and a sensor for detecting ink ejected from the printhead, comprising:

a printed circuit board (PCB) having:

a first side; and a second side opposite the first side;

an ink drop sensing element integral to the PCB first side;

sensing circuitry, coupled to the PCB second side, configured to receive electrical signals from the sensing element; and wherein the PCB further comprises;

conductive traces on the first side and the second side of the PCB;

conductive through-hole vias which connect select traces on the first side to select traces on the second side; and a mask covering the conductive traces on the first side and the second side of the PCB in areas where no electrical connection is desired.

11. A printing mechanism according to claim 10, further comprising a protective coating to protect the sensing circuitry, through-hole-vias, and conductive traces which are not covered by the mask from conductive ink residue.

12. A printing mechanism according to claim 11, wherein the mask covering the conductive traces comprises a material which does not react with the ink residue.

13. A printing mechanism according to claim 12, wherein the PCB further comprises a chamfered edge.

* * * * *